US009698488B2

(12) United States Patent
Kuo et al.

(10) Patent No.: US 9,698,488 B2
(45) Date of Patent: Jul. 4, 2017

(54) SATELLITE ANTENNA AND WAVEGUIDE FILTER THEREOF

(71) Applicant: Wistron NeWeb Corp., Hsinchu (TW)

(72) Inventors: Shun-Chung Kuo, Hsinchu (TW); Chang-Hsiu Huang, Hsinchu (TW)

(73) Assignee: Wistron Neweb Corp., Hsinchu (TW)

( * ) Notice: Subject to any disclaimer, the term of this patent is extended or adjusted under 35 U.S.C. 154(b) by 217 days.

(21) Appl. No.: 14/022,790

(22) Filed: Sep. 10, 2013

(65) Prior Publication Data

US 2014/0176379 A1 Jun. 26, 2014

(30) Foreign Application Priority Data

Dec. 25, 2012 (TW) ..... 101225024 U

(51) Int. Cl.
*H01Q 13/00* (2006.01)
*H01P 1/211* (2006.01)
*H01P 1/207* (2006.01)

(52) U.S. Cl.
CPC ..... *H01Q 13/00* (2013.01); *H01P 1/211* (2013.01); *H01P 1/207* (2013.01)

(58) Field of Classification Search
CPC ..... H01P 1/211; H01P 13/00; H01P 1/207
USPC ..... 343/781
See application file for complete search history.

(56) References Cited

U.S. PATENT DOCUMENTS 6,771,225 B2 * 8/2004 Tits ..... H01Q 13/0225 343/781 R
7,095,301 B2 * 8/2006 Hidaka ..... H01P 7/082 333/204
2002/0097116 A1 * 7/2002 Mack ..... H01P 1/207 333/208
2003/0006865 A1 * 1/2003 Kim ..... H01P 1/2002 333/208
2003/0206082 A1 * 11/2003 Chen ..... H01P 1/208 333/208
2004/0246072 A1 * 12/2004 Hidaka et al. ..... 333/134
2011/0032048 A1 * 2/2011 Wu ..... H01P 1/203 333/12

* cited by examiner

*Primary Examiner* — Dameon E Levi
*Assistant Examiner* — Walter Davis
(74) *Attorney, Agent, or Firm* — Muncy, Geissler, Olds & Lowe, P.C.

(57) ABSTRACT

A waveguide filter is provided. The waveguide filter includes a pipe and a first rib structure. The pipe includes a first inner wall. The first rib structure includes a first rib. The first rib is disposed in the pipe and formed on the first inner wall. The first rib includes a first section and a second section, wherein the first section and the second section extend on a first straight line and are perpendicular to the first inner wall, and a first gap is formed between the first section and the second section, and a first gap distance of the first gap is between 0.1 to 1.2 mm.

19 Claims, 8 Drawing Sheets

SATELLITE ANTENNA AND WAVEGUIDE FILTER THEREOF

CROSS REFERENCE TO RELATED APPLICATIONS

This Application claims priority of Taiwan Patent Application No. 101225024, filed on Dec. 25, 2012, the entirety of which is incorporated by reference herein.

BACKGROUND OF THE INVENTION

Field of the Invention

The present invention relates to a waveguide filter, and in particular, relates to a waveguide filter utilized in a satellite antenna.

Description of the Related Art

Conventional waveguide filters, such as Tapered Chebyshev function stub filters and Tapered Zolotarev function stub filters, have large dimensions due to impedance matching requirements.

The waveguide filters are commonly formed by molding. FIG. 1A shows a conventional waveguide filter 1, which has an upper structure 10 and a lower structure 20. The upper structure 10 has an upper rib 11, and the lower structure 20 has a lower rib 21. In the manufacturing process of the waveguide filter 1, the upper structure 10 and the lower structure 20 are formed by molding separately. In the assembled waveguide filter 1, a junction line 30 is kept away from the upper rib 11 and the lower rib 21 to assure surface smoothness of the upper rib 11 and the lower rib 21, and to prevent noise from being generated due to an uneven surface of the upper rib 11 and the lower rib 21.

However, if the junction line 30 passes through the ribs, the surfaces of the ribs are uneven due to manufacturing discrepancies, and noise is therefore generated. With reference to FIG. 1B, if the junction line 30' passes through the rib 11, the rib 11 is divided into a section 12 and a section 13, and an uneven portion 14 is formed between the section 12 and the section 13 due to the manufacturing discrepancies. Any uneven portion in the waveguide filter changes the impedance matching thereof. Thus, it is important that the junction line is kept away from the ribs or other important filtering structures.

BRIEF SUMMARY OF THE INVENTION

A waveguide filter is provided. The waveguide filter includes a pipe and a first rib structure. The pipe includes a first inner wall. The first rib structure includes a first rib. The first rib is disposed in the pipe and formed on the first inner wall. The first rib includes a first section and a second section, wherein the first section and the second section extend on a first straight line and are perpendicular to the first inner wall, and a first gap is formed between the first section and the second section, and a first gap distance of the first gap is between 0.1 to 1.2 mm.

The embodiment of the invention is characteristic in that due to proper design of the gap between the sections of the rib, the junction line is allowed to pass through the rib structure without deteriorating the performance of the waveguide filter. Utilizing the rib structure of the waveguide filter of an embodiment of the invention, the waveguide filter is capable of having a more complex structure. The mold to form the waveguide filter can be easily designed. A complex structured waveguide filter can be mass produced without deteriorating the electromagnetic performance of the waveguide filter.

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1A:
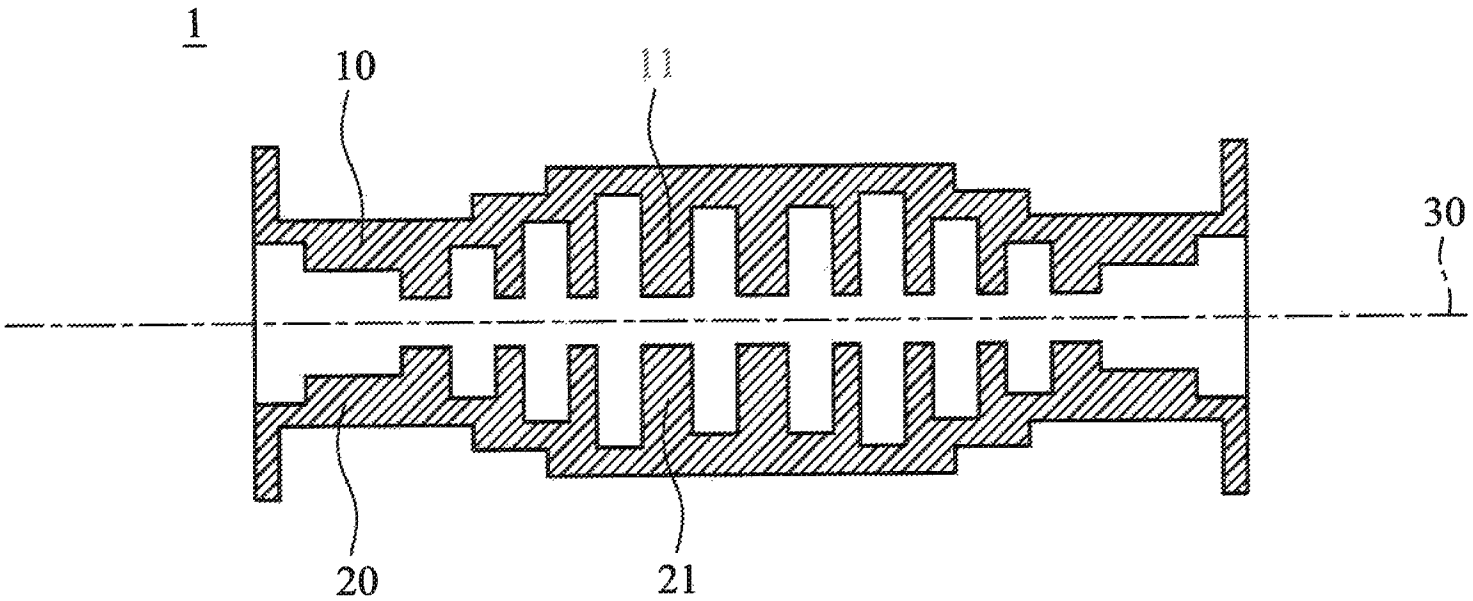
FIG. 1A ( PRIOR ART )
FIG. 1A shows a conventional waveguide filter.
Figure 1B:
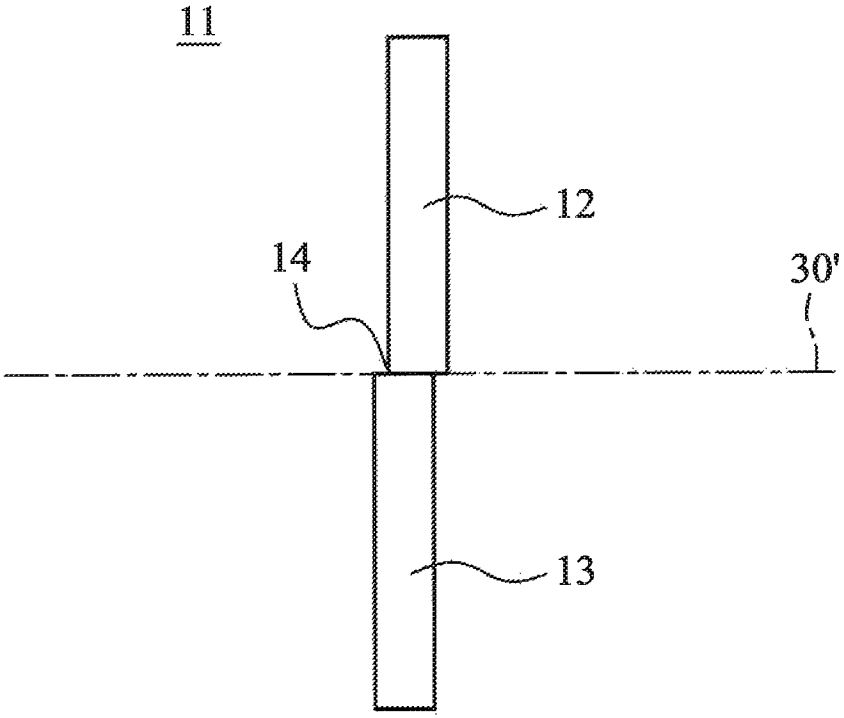
FIG. 1B ( PRIOR ART )
FIG. 1B shows a junction line passing through a rib of a conventional waveguide filter.
Figure 2A:
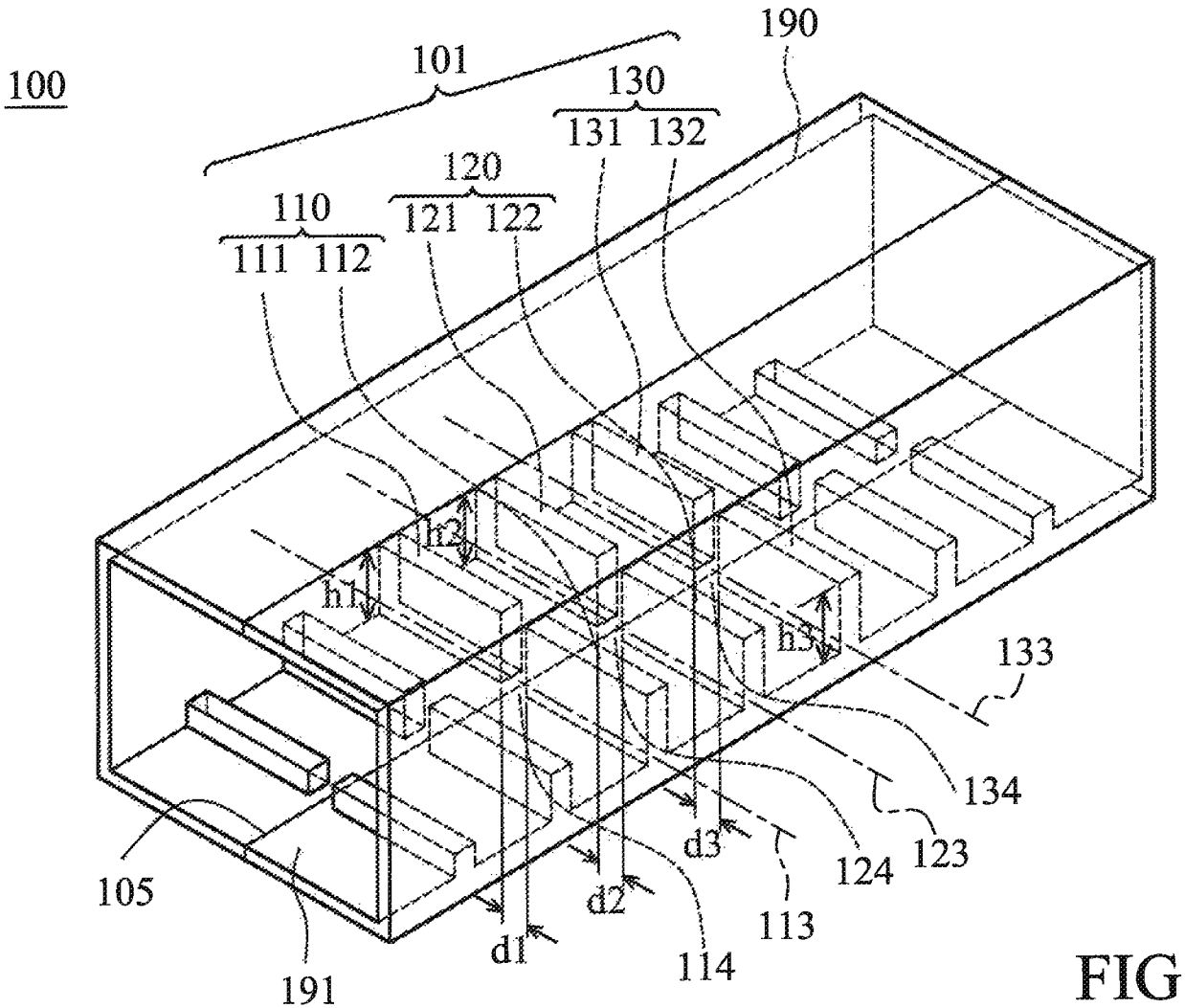
FIGS. 2A-2B are assembled views of the waveguide filter of an embodiment of the invention.

FIG. 2A shows a waveguide filter 100 of an embodiment of the invention, comprising a pipe 190 and a first rib structure 101. The first rib structure 101 comprises a first rib 110, a second rib 120 and a third rib 130. The pipe 190 comprises a first inner wall 191.

The first rib 110 is disposed in the pipe 190 and formed on the first inner wall 191. The first rib 110 comprises a first section 111 and a second section 112, wherein the first section 111 and the second section 112 extend on a first straight line 113, and are perpendicular to the first inner wall 191. A first gap 114 is formed between the first section 111 and the second section 112, and a first gap distance d1 of the first gap 114 is between 0.1 to 1.2 mm.

The second rib 120 is formed on the first inner wall 191 and parallel to the first rib 110. The second rib 120 comprises a third section 121 and a fourth section 122, wherein the third section 121 and the fourth section 122 extend on a second straight line 123, and are perpendicular to the first inner wall 191, and a second gap 124 is formed between the third section 121 and the fourth section 122, and a second gap distance d2 of the second gap 124 is between 0.1 to 1.2 mm.

The third rib 130 is formed on the first inner wall 191 and parallel to the first rib 110, wherein the second rib 120 is located between the first rib 110 and the third rib 130. The third rib 130 comprises a fifth section 131 and a sixth section 132. The fifth section 131 and the sixth section 132 extend on a third straight line 133, and are perpendicular to the first inner wall 191. A third gap 134 is formed between the fifth section 131 and the sixth section 132, and a third gap distance d3 of the third gap 134 is between 0.1 to 1.2 mm.

In this embodiment, the first inner wall 191 is planar. The central portion of the first rib structure 101 is relatively high, and both side portions of the first rib structure 101 are relatively low. The first rib 110 has a first height h1, the second rib 120 has a second height h2, and the third rib 130 has a third height h3. The second height h2 is higher than the first height h1 and the third height h3. However, the embodiment disclosed does not restrict the invention. For example, in one embodiment, the central portion of the first rib structure 101 is relatively low, and the both side portions of the first rib structure 101 are relatively high. In another embodiment, the all portions of the first rib structure 101 have one single height. Other proper modifications to the first rib structure are also possible.

Figure 2B:
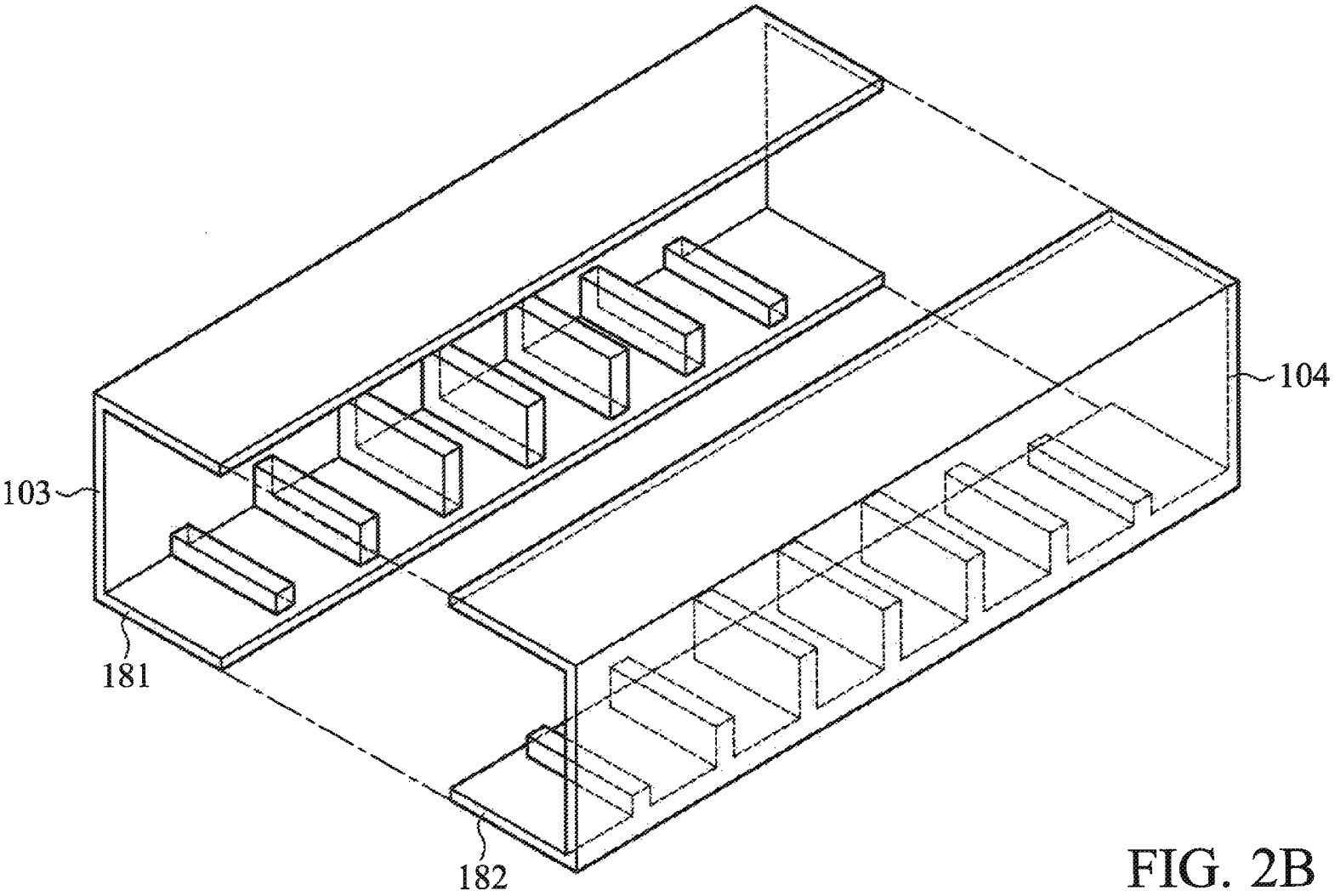

With reference to FIGS. 2A and 2B, different from the conventional concept, a junction line 105 of the waveguide filter passes through the rib structure, and divides the waveguide filter into a first member 103 and a second member 104. The first member 103 and the second member 104 compose the waveguide filter. The first section 111 is integrally formed on the first member 103, and the second section 112 is integrally formed on the second member 104. The cross section of the pipe 190 is rectangular, the end cross section 181 of the first member 103 is U-shaped, and the end cross section 182 of the second member 104 is U-shaped.

Figure 3:
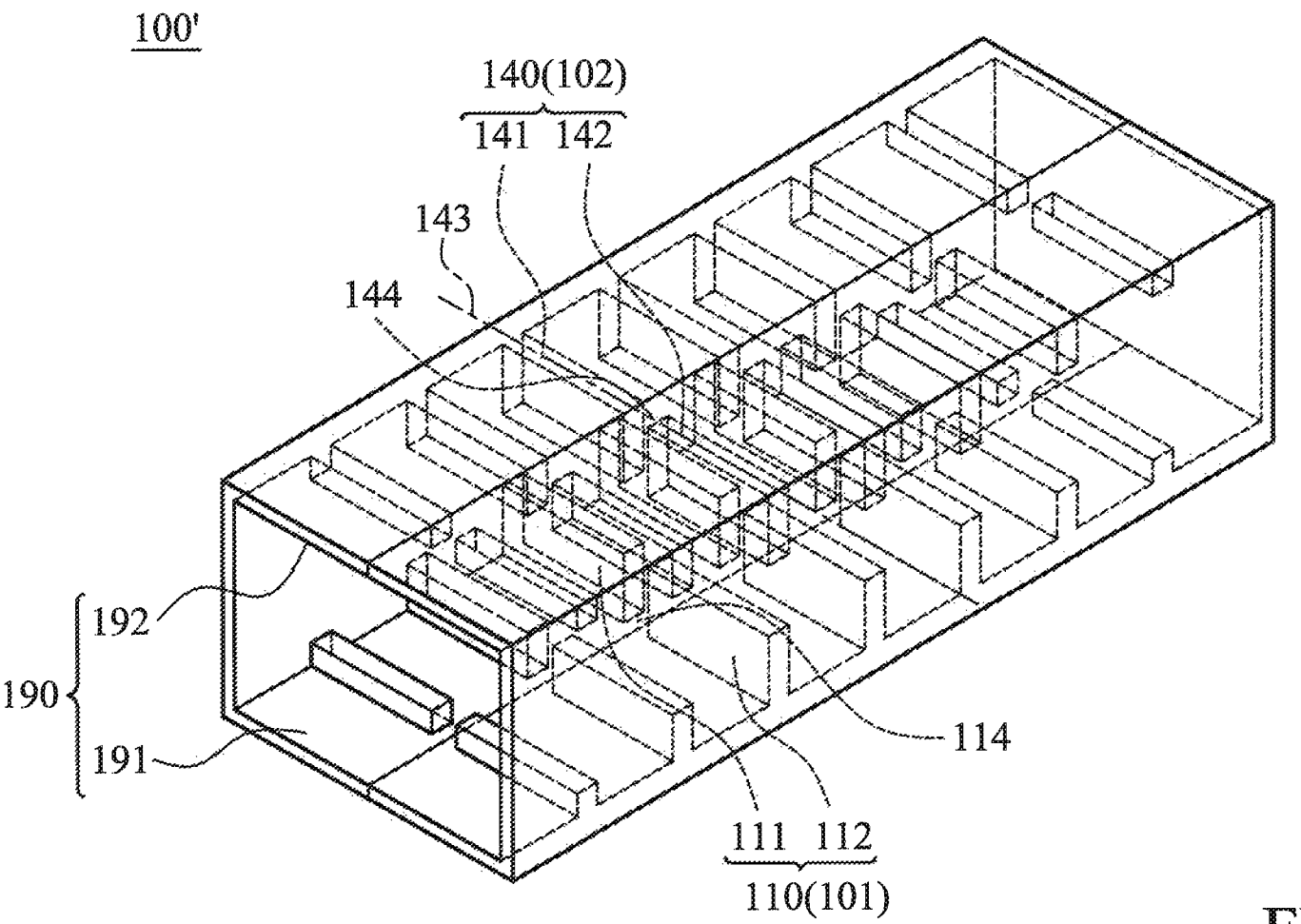
FIG. 3 shows the waveguide filter of another embodiment of the invention.

FIG. 3 shows a waveguide filter 100' of another embodiment of the invention, comprising a pipe 190, a first rib structure 101 and a second rib structure 102. The second rib structure 102 is disposed in the pipe 190. The pipe 190 comprises a second inner wall 192. The second inner wall 192 is planar and facing to the first inner wall 191. The second rib structure 102 is formed on the second inner wall 192. The first rib structure 101 is symmetric to the second rib structure 102. Similar to the first rib structure 101, the second rib structure 102 comprises a fourth rib 140. The fourth rib 140 comprises a seventh section 141 and an eighth section 142, wherein the seventh section 141 and the eighth section 142 extend on a fourth straight line 143, and are perpendicular to the second inner wall 192. A fourth gap 144 is formed between the seventh section 141 and the eighth section 142, and a fourth gap distance of the fourth gap 144 is between 0.1 to 1.2 mm, wherein the first gap 114 and the fourth gap 144 are on a same straight line.

Figure 4:
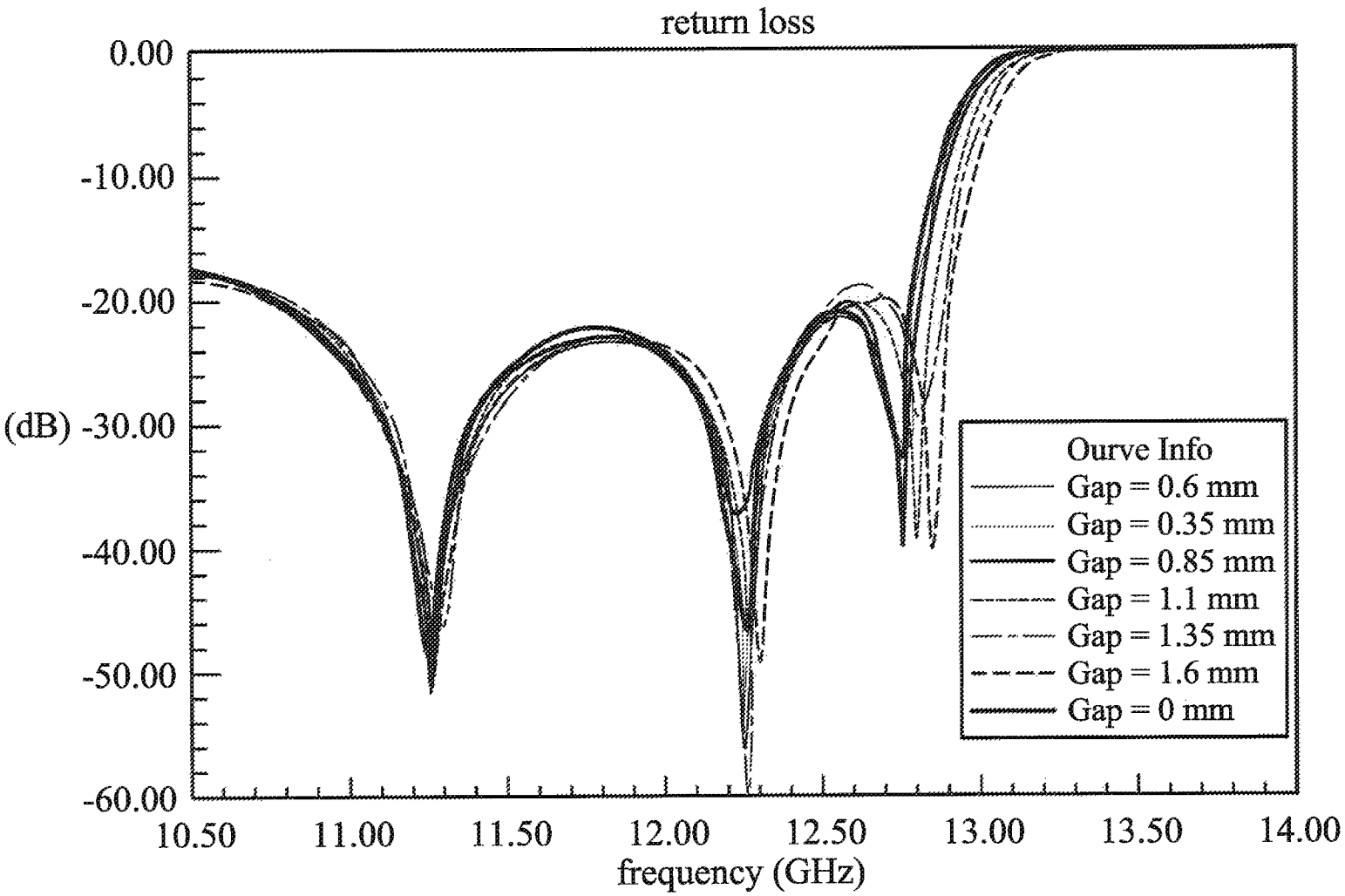
FIG. 4 shows the return loss of the waveguide filter of the embodiment of FIG. 2A.
Figure 5:
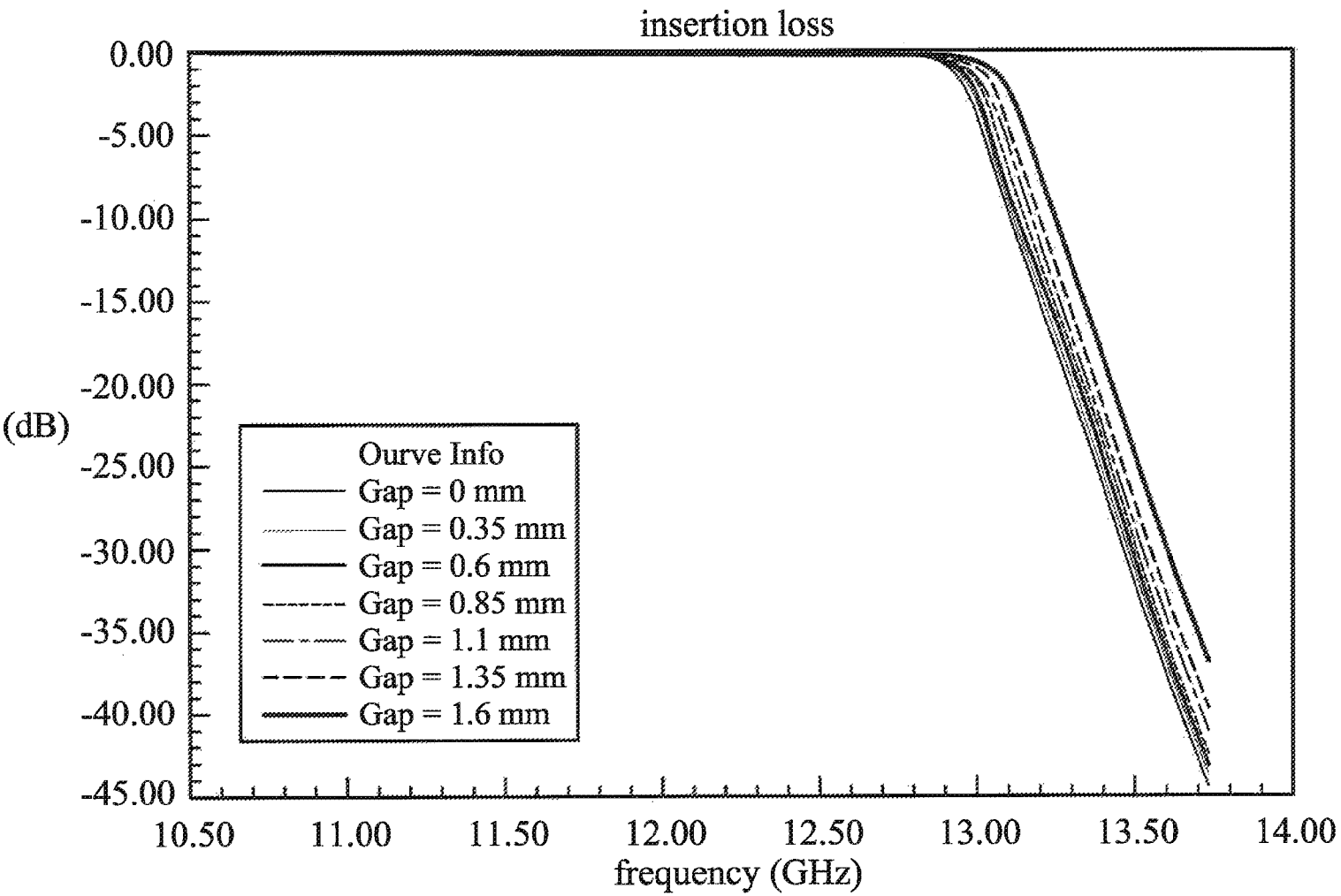
FIG. 5 shows the insertion loss of the waveguide filter of the embodiment of FIG. 2A.

The embodiment of the invention is characteristic in that due to proper design of the gap between the sections of the rib, the junction line is allowed to pass through the rib structure without deteriorating the performance of the waveguide filter. With reference to FIGS. 4 and 5, FIG. 4 shows the return loss of the waveguide filter of the embodiment of FIG. 2A. As shown in FIG. 4, compared to the situation where the gap is zero (without the junction line passing the rib structure), the return loss of the waveguide filter does not obviously deteriorate when the gap is between 0.1 to 1.2 mm. FIG. 5 shows the insertion loss of the waveguide filter of the embodiment of FIG. 2A. As shown in FIG. 5, compared to the situation where the gap is zero (without the junction line passing the rib structure), the insertion loss of the waveguide filter does not obviously deteriorate when the gap is between 0.1 to 1.2 mm.

In the embodiments of the invention, the amount of the ribs of the first rib structure 101 and the amount of the second rib structure 102 are seven. However, the invention is not limited thereby. The amount of the ribs of the first rib structure and the amount of the second rib structure can be modified according to the design requirement.

Figure 6:
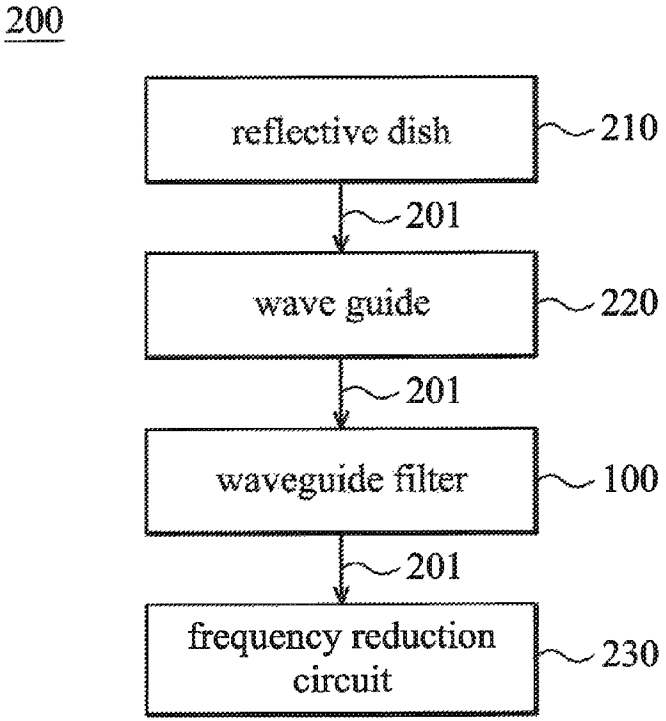
FIG. 6 is the block diagram of a satellite antenna of an embodiment of the invention.

FIG. 6 is a block diagram of a satellite antenna 200 of an embodiment of the Invention. The satellite antenna 200 comprises a reflective dish 210, a wave guide 220, the waveguide filter 100 mentioned above and a frequency reduction circuit 230. The reflective dish 210 receives a wireless signal 201. The wave guide 220 receives the wireless signal 201 from the reflective dish 210. The waveguide filter 100 is connected to the wave guide 220 to filter the wireless signal 201. The frequency reduction circuit 230 is connected to the waveguide filter 100 to process the wireless signal 201.

Utilizing the rib structure of the waveguide filter of the embodiment of the invention, the waveguide filter is capable of having a more complex structure. The mold to form the waveguide filter can be easily designed. A complex structured waveguide filter can be mass produced without deteriorating the electromagnetic performance of the waveguide filter.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A waveguide filter, comprising:

a pipe, comprising a first inner wall; and a first rib structure, comprising:

a first rib, disposed in the pipe and formed on the first inner wall, wherein the first rib comprises a first section and a second section, wherein the first section and the second section extend on a first straight line and are perpendicular to the first inner wall, and a first gap is formed between the first section and the second section, and a first gap distance of the first gap is between 0.1 to 1.2 mm, wherein the first gap is empty, wherein there is no electrically conductive material disposed between the first section and the second section, wherein the first rib structure further comprises a second rib formed on the first inner wall and parallel to the first rib, wherein the first rib structure further comprises a third rib formed on the first inner wall and parallel to the first rib, wherein the second rib is located between the first rib and the third rib, wherein the first rib has a first height, the second rib has a second height, the third rib has a third height, and the second height is higher than the first height and the third height.

2. The waveguide filter as claimed in claim 1, wherein the second rib comprises a third section and a fourth section, wherein the third section and the fourth section extend on a second straight line and are perpendicular to the first inner wall, and a second gap is formed between the third section and the fourth section, and a second gap distance of the second gap is between 0.1 to 1.2 mm.

3. The waveguide filter as claimed in claim 1, the third rib comprises a fifth section and a sixth section, wherein the fifth section and the sixth section extend on a third straight line and are perpendicular to the first inner wall, and a third gap is formed between the fifth section and the sixth section, and a third gap distance of the third gap is between 0.1 to 1.2 mm.

4. The waveguide filter as claimed in claim 1, wherein the first inner wall is planar.

5. The waveguide filter as claimed in claim 1, further comprising a second rib structure disposed in the pipe wherein the pipe comprises a second inner wall, and the second inner wall is facing to the first inner wall, and the second rib structure is formed on the second inner wall, and the second rib structure comprises:

a fourth rib, comprising a seventh section and an eighth section, wherein the seventh section and the eighth section extend on a fourth straight line and are perpendicular to the second inner wall, and a fourth gap is formed between the seventh section and the eighth section, and a fourth gap distance of the fourth gap is between 0.1 to 1.2 mm, wherein the first gap and the fourth gap are on a same straight line.

6. The waveguide filter as claimed in claim 5, wherein the first rib structure is symmetric to the second rib structure.

7. The waveguide filter as claimed in claim 5, wherein the second inner wall is planar.

8. The waveguide filter as claimed in claim 1, further comprising a first member and a second member, wherein the first member and the second member compose the waveguide filter, and the first section is integrally formed on the first member, and the second section is integrally formed on the second member.

9. The waveguide filter as claimed in claim 8, wherein a cross section of the pipe is rectangular, and cross sections of the ends of the first member and the second member are U-shaped.

10. A satellite antenna, comprising:

a reflective dish, receiving a wireless signal;

a wave guide, receiving the wireless signal from the reflective dish;

a waveguide filter, connected to the wave guide to filter the wireless signal, wherein the waveguide filter comprises:

a pipe, comprising a first inner wall; and a first rib structure, comprising:

a first rib, disposed in the pipe and formed on the first inner wall, wherein the first rib comprises a first section and a second section, wherein the first section and the second section extend on a first straight line and are perpendicular to the first inner wall, and a first gap is formed between the first section and the second section, and a first gap distance of the first gap is between 0.1 to 1.2 mm, wherein the first gap is empty; and a frequency reduction circuit, connected to the waveguide filter to process the wireless signal, wherein there is no electrically conductive material disposed between the first section and the second section, wherein the first rib structure further comprises a second rib formed on the first inner wall and parallel to the first rib, wherein the first rib structure further comprises a third rib formed on the first inner wall and parallel to the first rib, wherein the second rib is located between the first rib and the third rib, wherein the first rib has a first height, the second rib has a second height, the third rib has a third height, and the second height is higher than the first height and the third height.

11. The satellite antenna as claimed in claim 10, wherein the second rib comprises a third section and a fourth section, wherein the third section and the fourth section extend on a second straight line and are perpendicular to the first inner wall, and a second gap is formed between the third section and the fourth section, and a second gap distance of the second gap is between 0.1 to 1.2 mm.

12. The satellite antenna as claimed in claim 10, wherein the first inner wall is planar.

13. The satellite antenna as claimed in claim 10, wherein the waveguide filter further comprises a second rib structure disposed in the pipe, wherein the pipe comprises a second inner wall, and the second inner wall is facing to the first inner wall, and the second rib structure is formed on the second inner wall, and the second rib structure comprises:

a fourth rib, comprising a seventh section and an eighth section, wherein the seventh section and the eighth section extend on a fourth straight line and are perpendicular to the second inner wall, and a fourth gap is formed between the seventh section and the eighth section, and a fourth gap distance of the fourth gap is between 0.1 to 1.2 mm, wherein the first gap and the fourth gap are on a same straight line.

14. The satellite antenna as claimed in claim 13, wherein the first rib structure is symmetric to the second rib structure.

15. The satellite antenna as claimed in claim 13, wherein the second inner wall is planar.

16. The satellite antenna as claimed in claim 10, further comprising a first member and a second member, wherein the first member and the second member compose the waveguide filter, and the first section is integrally formed on the first member, and the second section is integrally formed on the second member.

17. The satellite antenna as claimed in claim 16, wherein a cross section of the pipe is rectangular, and cross sections of the ends of the first member and the second member are U-shaped.

18. A waveguide filter, comprising:

a pipe, comprising a first planar inner wall; and a first rib structure, comprising:

a first rib, disposed in the pipe and extending from the first inner wall in a first direction, wherein the first rib comprises a first section and a second section, wherein the first section and the second section locate on a first straight line and are perpendicular to the first inner wall, and a first gap is formed between the first section and the second section, and a first gap distance of the first gap is between 0.1 to 1.2 mm, wherein the first rib has a first height in the first direction, and the first height is smaller than half of an inner diameter of the pipe.

19. The satellite antenna as claimed in claim 10, wherein an axis of the pipe is located on a central plane, the central plane is perpendicular to the first, second and the third ribs, a first distance is formed between the first rib and the central plane, a second distance is formed between the second rib and the central plane, a third distance is formed between the third rib and the central plane, and the second distance is shorter than the first distance and the third distance.

* * * * *